US010434525B1

(12) United States Patent
Cooper

(10) Patent No.: US 10,434,525 B1
(45) Date of Patent: Oct. 8, 2019

(54) ELECTROSTATIC LIQUID SPRAYER USAGE TRACKING AND CERTIFICATION STATUS CONTROL SYSTEM

(71) Applicant: Steven C. Cooper, Athens, GA (US)

(72) Inventor: Steven C. Cooper, Athens, GA (US)

( * ) Notice: Subject to any disclaimer, the term of this patent is extended or adjusted under 35 U.S.C. 154(b) by 135 days.

(21) Appl. No.: 15/637,215

(22) Filed: Jun. 29, 2017

Related U.S. Application Data

(63) Continuation of application No. 15/019,324, filed on Feb. 9, 2016, now abandoned.

(51) Int. Cl.

| | |
|---|---|
| ***B05B 5/00*** | (2006.01) |
| ***B05B 5/03*** | (2006.01) |
| ***B05B 12/00*** | (2018.01) |
| ***B05B 12/12*** | (2006.01) |
| ***B05B 12/08*** | (2006.01) |

(52) U.S. Cl.
CPC ..... *B05B 5/03* (2013.01); *B05B 12/004* (2013.01); *B05B 12/08* (2013.01); *B05B 12/12* (2013.01)

(58) Field of Classification Search
CPC ... B05B 12/008; B05B 12/004; B05B 12/085; B05B 12/1436; B05B 12/02; B05B 7/02
USPC ..... 700/282, 283, 285; 239/71
See application file for complete search history.

(56) References Cited

U.S. PATENT DOCUMENTS 2,224,540 A * 12/1940 Fraser ..... B67D 7/30 222/17
4,601,921 A * 7/1986 Lee ..... B05B 5/0407 118/300
4,722,625 A * 2/1988 O'Brien ..... B05B 12/00 200/520
4,809,909 A * 3/1989 Kukesh ..... B05B 7/24 239/1
4,915,599 A * 4/1990 Katsuyama ..... B05B 7/24 222/135
5,058,805 A * 10/1991 Anderson ..... B05B 7/1218 239/124
5,064,120 A * 11/1991 Luttrell, Jr. ..... B05B 12/008 239/74
5,074,237 A * 12/1991 Ogasawara ..... B05B 12/14 118/302
5,099,687 A * 3/1992 Lunzer ..... B67D 7/20 73/198
5,100,060 A * 3/1992 Haferkorn ..... B05B 7/241 137/209

(Continued)

*Primary Examiner* — Viet Le
(74) *Attorney, Agent, or Firm* — Mitch Harris, Atty at Law, LLC; Andrew M. Harris

(57) ABSTRACT

An electrostatic sprayer system for spraying a liquid includes a control system that provides user certification status control and usage reporting for the electrostatic sprayer system, including authorizing the user in conformity with the user's certification status and tracking the user, material(s), locations, duration of operation and amount of material being sprayed. The sprayer system includes a sprayer head having an outlet for dispensing a liquid that has been atomized and electrically charged via an electrode of the sprayer system, a vessel containing the liquid prior to dispensing, a power supply for providing a voltage and current to the electrode, a flow controller for controlling flow of liquid emitted from an outlet of the sprayer head, and a control system for controlling the flow controller in conformity with a certification status of a user of the sprayer system and reporting usage of the sprayer system to a database.

24 Claims, 9 Drawing Sheets

(56) References Cited

U.S. PATENT DOCUMENTS 5,135,172 A * 8/1992 Toth ..... B05B 7/0081 239/297
5,182,704 A * 1/1993 Bengtsson ..... G05D 7/0688 118/696
5,228,622 A * 7/1993 Murphy ..... B05B 7/24 137/885
5,240,181 A * 8/1993 Uribe ..... B05B 7/0081 239/135
5,388,761 A * 2/1995 Langeman ..... B01F 15/00285 222/138
5,505,763 A * 4/1996 Reighard ..... B05B 14/43 95/19
5,618,347 A * 4/1997 Clare ..... B05C 5/0279 118/313
5,619,324 A * 4/1997 Harvill ..... G01N 15/0211 356/336
5,629,570 A * 5/1997 Weigert ..... B05B 12/00 239/63
5,636,653 A * 6/1997 Titus ..... G01F 1/34 137/14
5,908,140 A * 6/1999 Muderlak ..... A61L 9/14 222/1
6,045,056 A * 4/2000 Tardoni ..... B05B 7/00 118/300
6,059,884 A * 5/2000 Seitz ..... B05B 7/1472 118/679
6,120,832 A * 9/2000 Walsh ..... B05B 12/124 118/624
6,149,071 A * 11/2000 MacCallumMhor ..... B05B 12/085 239/67
6,223,645 B1 * 5/2001 Elberson ..... B05B 7/2491 239/569
6,226,568 B1 * 5/2001 Tong ..... B05B 16/20 700/277
6,371,451 B1 * 4/2002 Choi ..... A45D 34/02 261/115
6,375,094 B1 * 4/2002 Schroeder ..... B05B 5/032 239/113
6,379,465 B1 * 4/2002 Perkins ..... B05B 5/00 118/308
6,500,262 B1 * 12/2002 Bednarz ..... B05B 15/00 118/696
6,528,109 B1 * 3/2003 Filev ..... B05B 12/12 118/313
6,543,647 B1 * 4/2003 Buchholz ..... B01F 15/0429 222/134
6,564,154 B1 * 5/2003 Zimmerman ..... B05B 12/00 427/331
6,585,173 B2 * 7/2003 Schmon ..... B05B 12/008 239/290
6,658,829 B2 * 12/2003 Kobayashi ..... A01D 34/6806 56/10.5
6,696,944 B2 * 2/2004 Knittle ..... B05B 12/006 239/71
6,804,390 B2 * 10/2004 McClanahan ..... G01J 3/46 382/156
6,829,522 B1 * 12/2004 Filev ..... G01P 5/02 700/282
6,896,152 B2 * 5/2005 Pittman ..... B01F 13/1055 222/135
6,935,575 B2 * 8/2005 Lacchia ..... B05B 5/053 239/290
7,024,285 B2 * 4/2006 Saelens ..... B05B 12/085 239/69
7,114,670 B2 * 10/2006 Robidoux ..... B05B 5/1683 239/699
7,171,394 B2 * 1/2007 Filev ..... G05B 13/027 706/19
7,264,160 B2 * 9/2007 Polarine ..... G07C 3/08 235/385
7,509,864 B2 * 3/2009 Charpie ..... B05B 7/2416 239/346
7,822,845 B2 * 10/2010 Polarine ..... G06Q 10/087 709/224
8,037,844 B2 * 10/2011 Mather ..... B05B 15/55 118/695
8,109,685 B1 * 2/2012 Vito ..... A46B 5/0095 401/188 R
8,113,445 B2 * 2/2012 Drozd ..... B05B 7/066 239/292
8,192,785 B2 * 6/2012 Pacetti ..... A61L 31/10 106/499
8,486,030 B2 * 7/2013 Thomason ..... A61M 35/003 239/133
8,561,921 B1 * 10/2013 Showman ..... B05B 7/0018 239/414
8,601,977 B2 * 12/2013 Mauchle ..... B05B 7/1404 118/695
8,782,026 B2 * 7/2014 Poland ..... B05D 5/06 707/705
9,649,651 B2 * 5/2017 Mather ..... B05B 15/55
9,744,388 B2 * 8/2017 Ewers ..... A62C 5/02
9,839,936 B2 * 12/2017 Hoffman ..... B05D 1/02
2004/0177975 A1 * 9/2004 Laskaris ..... A62C 5/02 169/13
2005/0011967 A1 * 1/2005 Skelton-Becker ..... G05B 9/02 239/101
2005/0127201 A1 * 6/2005 Matsumoto ..... B05B 12/008 239/71
2005/0284892 A1 * 12/2005 Weems ..... F16N 5/02 222/333
2007/0017443 A1 * 1/2007 Skelton-Becker .... B05B 7/1477 118/712
2007/0209586 A1 * 9/2007 Ebensberger ..... G09B 9/00 118/682
2008/0029615 A1 * 2/2008 Davies ..... B05B 12/008 239/74
2008/0111001 A1 * 5/2008 Elmer ..... A01G 25/16 239/11
2008/0142615 A1 * 6/2008 Chen ..... B05B 9/01 239/74
2008/0251607 A1 * 10/2008 Krayer ..... B05B 7/0081 239/290
2009/0110803 A1 * 4/2009 Mather ..... B05B 15/55 427/8
2009/0235864 A1 * 9/2009 Khoury ..... B05B 12/008 118/668
2009/0293189 A1 * 12/2009 Somerville ..... B05B 1/18 4/597
2010/0270328 A1 * 10/2010 Quinlan ..... A47K 5/16 222/1
2011/0042478 A1 * 2/2011 Ikushima ..... B05B 12/008 239/11
2011/0114749 A1 * 5/2011 Munn ..... B05B 7/2405 239/74
2011/0303311 A1 * 12/2011 Klicpera ..... B05B 12/008 137/551
2012/0009329 A1 * 1/2012 Mather ..... B05B 15/55 427/8
2012/0072035 A1 * 3/2012 Nielsen ..... B05B 12/004 700/283
2012/0109660 A1 * 5/2012 Xu ..... G06Q 10/06 705/1.1
2012/0228395 A1 * 9/2012 Needham et al. .... F16K 3/0606 239/11
2012/0273069 A1 * 11/2012 Klicpera ..... B05B 12/008 137/551
2013/0048318 A1 * 2/2013 Ewers ..... A62C 5/02 169/46
2013/0083991 A1 * 4/2013 Rodrigues ..... B05D 5/005 382/141
2013/0153684 A1 * 6/2013 Taranta ..... B05B 9/0409 239/337
2013/0262033 A1 * 10/2013 Henson ..... G06Q 30/01 702/183

(56) References Cited

U.S. PATENT DOCUMENTS

2013/0269685 A1* 10/2013 Wachtel ..... A61M 15/0065 128/200.21
2014/0042241 A1* 2/2014 Cai ..... B05B 3/04 239/71
2014/0079652 A1* 3/2014 Cooper ..... B05B 7/2489 424/59
2014/0084075 A1* 3/2014 Vandelli ..... G01F 15/005 239/1
2014/0084078 A1* 3/2014 Nelson ..... B05B 15/70 239/69
2014/0131473 A1* 5/2014 Yan ..... B05B 12/006 239/71
2014/0252118 A1* 9/2014 Tsai ..... B05B 12/008 239/74
2015/0108244 A1* 4/2015 Pruiett ..... A47L 11/34 239/71
2015/0202661 A1* 7/2015 Buijsman ..... B28B 7/388 427/8
2015/0260600 A1* 9/2015 Hata ..... G01L 19/00 73/756
2015/0272106 A1* 10/2015 Schertz ..... A01M 7/0089 239/11
2015/0283567 A1* 10/2015 Sulzer ..... B05B 7/2494 239/62
2016/0030960 A1* 2/2016 Gehrung ..... B05B 11/0005 239/526
2016/0175869 A1* 6/2016 Sullivan ..... B05B 12/008 239/11
2016/0207055 A1* 7/2016 Peter McGuffie ..... B05B 7/26
2016/0228901 A1* 8/2016 Hooper ..... B05B 12/008
2016/0303580 A1* 10/2016 Cai ..... B05B 1/18
2016/0346800 A1* 12/2016 McMichael ..... G05D 7/0688
2017/0000994 A1* 1/2017 Hipperson ..... B05B 12/004
2017/0135529 A1* 5/2017 Joyer ..... A61H 35/00
2017/0136479 A1* 5/2017 Ophardt ..... A47K 5/1211

* cited by examiner

ELECTROSTATIC LIQUID SPRAYER USAGE TRACKING AND CERTIFICATION STATUS CONTROL SYSTEM

This U.S. Patent Application is a Continuation of U.S. patent application Ser. No. 15/019,324 filed on Feb. 9, 2016, and claims priority thereto under 35 U.S.C. § 120.

BACKGROUND OF THE INVENTION

1. Field of the Invention

The present invention relates to electrostatic liquid sprayer systems, and in particular a control system for an electrostatic liquid sprayer system having usage tracking and certification status control features.

2. Background of the Invention

An air-assisted induction-charging electrostatic spraying process produces a charged spray of atomized liquid droplets containing a spray agent delivered in an air stream. Advantages of electrostatic spraying are more uniform spray cloud dispersion into a space, as well as improved deposition uniformity and efficiency of deposition onto complex three-dimensional surfaces to be coated. Electrostatic spraying often allows a lower volume of liquid to be used to coat surfaces than would be required by uncharged conventional hydraulic spraying. The improved efficiency permits surfaces such as fabric or paper products to be sprayed without significant wetting of the materials. Many types of target surfaces are currently coated using electrostatic sprays. Applications vary from agricultural crop spraying to spraying of automobiles, appliances, furniture and many other manufactured goods. Unique opportunities for electrostatic spraying are still emerging. For example, recently developed applications involve coating of surfaces with sanitizing agents for odor control and the prevention of illness caused by virus and bacteria in areas of high human concentration such as hotels, hospitals, restaurants, schools, day care services, military installations and cruise ships.

For each type, brand, concentration and particular application of a spray agent, a different spray protocol may be required to obtain optimum efficiency and to ensure safety. The spray protocol is sometimes specified on a container of the spray compound, but may also or alternatively be called out in procedures or specifications associated with the entity performing or requesting the spraying of the spray compound. Users dispensing sprays in a commercial environment typically require certification that assures that the proper spray protocols are understood for the particular spray compounds.

As there are many types of liquid and/or powders that might be applied with a sprayer system and numerous applications which may be considered critical or applications of materials that might be hazardous alone or in combination, and each may have unique spray protocols, it is desirable to provide an electrostatic sprayer system that has usage tracking and certification control features.

SUMMARY OF THE INVENTION

The above objectives, as well as others, are accomplished in a control and recordkeeping system for an electrostatic sprayer system, as well as a method of operation of the electrostatic sprayer system.

The electrostatic sprayer system includes a sprayer head having a sprayer outlet for dispensing a liquid that has been charged via an electrode of the sprayer head, an air compressor for supplying pressurized air to the sprayer head to form an air sheath between a liquid outlet and the electrode to eject the electrically charged liquid emitted from the liquid outlet, a vessel containing the liquid prior to dispensing, a power supply for providing a voltage and current to the electrode, a flow controller for controlling a flow of the fluid emitted from the liquid outlet, and a control system that controls the flow controller in conformity with a certification status of a user of the sprayer system on a per-job basis and reports the usage of the electrostatic sprayer system by the user for a current job to a database.

The foregoing and other objectives, features, and advantages of the invention will be apparent from the following, more particular, description of the preferred embodiment of the invention, as illustrated in the accompanying drawings.

BRIEF DESCRIPTION OF THE DRAWINGS

The novel features believed characteristic of the invention are set forth in the appended claims. The invention itself, however, as well as a preferred mode of use, further objectives, and advantages thereof, will best be understood by reference to the following detailed description of the invention when read in conjunction with the accompanying Figures, wherein like reference numerals indicate like components, and:

DESCRIPTION OF ILLUSTRATIVE EMBODIMENT

Figure 1:
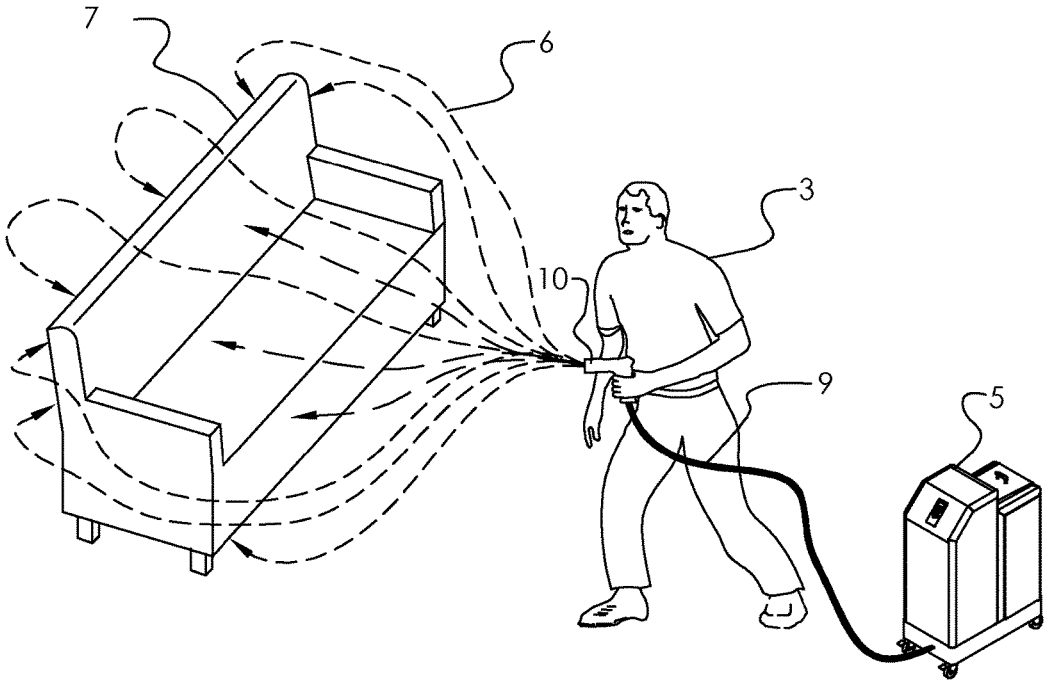
FIG. 1 is a pictorial diagram depicting operation of an exemplary electrostatic sprayer system.

The present invention concerns electrostatic sprayer control systems features, specifically features that track usage of, and control authorization to operate portable or otherwise mobile electrostatic spraying systems. The sprayer system verifies that the user of the sprayer is certified to use the sprayer and authorizes spraying only if a certification requirement is met. A database that contains the certification is accessed in an on-line or off-line manner to set the certification status of the user, in accordance with training requirements and other standards determined by the managers of the overall system of which the sprayer system forms a part. The sprayer system further reports parameters of the usage to the database in an on-line or off-line manner, on a per-job basis, a "job" being a spraying task that requires dispensing of a particular spray compound in a particular location at a particular time. The complete electrostatic spraying system generally includes a remote computer system containing the database and that communicates with multiple portable/mobile electrostatic sprayers. For example, portable electrostatic sprayers may wirelessly communicate with a base computer system that tracks usage by individual certified users, geographic locations and type of spray compound being applied by the sprayer, which may be the liquid applied by the sprayer or the spray compound may be mixed with a liquid such as water. Alternatively, the sprayer system may be self-contained with authorization controlled by the software embedded in the sprayer, with updates to the certification status of one or more potential users of the sprayer not being updated on a per-job basis if the database is not accessible in an on-line manner. In such instances, a user that has lost certified status is allowed to proceed with the current job(s) until the sprayer system is again on-line, but once the sprayer system is again synchronized with the database, authority for the particular user to operate the sprayer will be removed in conformity with the loss of certified status.

Mobile sprayers, such as large-scale agricultural electrostatic sprayers may also be tracked geographically and for the types of spray compound applied. By tracking usage, location and type of spray compound and sending the collected information to a database from which reports are generated, over-application can be avoided and coverage can be ensured by detecting missed application areas or schedules. Uses of the sprayers disclosed herein include application of spray compounds such as pesticides, fungicides, odor control sprays, barrier treatments and sanitizers. The spray compounds may be dispensed in agricultural fields or storage areas, human and animal health care facilities, restrooms, food processing locations, restaurants, day care and nursing facilities, hotels, cruise ships, offices, aircraft and other locations. Further, proper operation of the sprayer during the application of the spray compounds can be verified by tracking operating parameters of the sprayer, such as electrode current and voltage, sprayer air pressure, liquid flow rates, etc., the generated reports can be used for operational verification and maintenance purposes, as well.

Referring now to FIG. 1, an electrostatic sprayer system and method for disinfecting items in a room are illustrated. A sprayer head 10 that dispenses an electrostatically-charged disinfecting spray cloud is directed at a target, such as sofa 7, by a user 3. Sprayer head 10 is an electrostatic sprayer head in accordance with an embodiment of the invention as illustrated in further detail below. A base unit 5 provides a source of liquid forming or containing the spray compound, although the liquid may be contained in a reservoir attached to or contained within sprayer head 10. Base unit 5 also supplies air pressure via hose connection 9, and optionally provides a source of power, although a battery within sprayer head 10 may be included to provide power. Further, while the illustrative examples given herein generally describe an air compressor supplying the air stream to sprayer head 10 it is understood that lower pressure air sources such as fans, blowers, turbines, etc. may be used to supply the air stream, when higher pressure levels are not required for a given application. While base unit 5 is depicted as a rolling movable chassis, alternatively base unit 5 may be a backpack worn by user 3, or a stationary unit into which sprayer head 10 is connected. The spray ejected from the tip of sprayer head 10 coats surfaces more uniformly and generates a spray cloud pattern that can reach hidden surfaces underneath and behind sofa 7 providing more effective disinfection than would be possible with ordinary sprays and without moving and upending sofa 7. Sprayer head 10 is generally dispensing a low-volume spray of liquid at a flow rate of less than 300 ml per minute and preferably less than 150 ml per minute to prevent significant wetting of sensitive targets such as the fabric of sofa 7 or other items in the room such as paper items. The spray compound being applied by user 3 may be a disinfectant, a pesticide or some form of cleaner, all of which may require that the room containing sofa 7 remain vacant for a predetermined period of time and may require that subsequent application is not made for another specified period of time. Further, it may be critical in the case of shared living facilities, such as cruise ship staterooms or hotels, or in medical facilities, that the application of particular spray compound agents not be missed, so that requirements for sanitary condition of the room are met with respect to a certain schedule, or turn-over of the room. The electrostatic sprayer system contains control electronics and computer program products within base unit 5, sprayer head 10 and/or a remote computer system that communicates with base unit 5 and/or sprayer head 10 to control authorization for operation and logging of usage of sprayer head 10. Base unit 5 may include a pocket or recess for accepting and retaining a mobile device of the user, such as a smart phone, tablet or pad, which is inserted into the pocket or recess of base unit 5. Electrical connections for power and/or wired interface, such as a Universal Serial Bus (USB) connection, may be provided in the pocket or recess.

Figure 2:
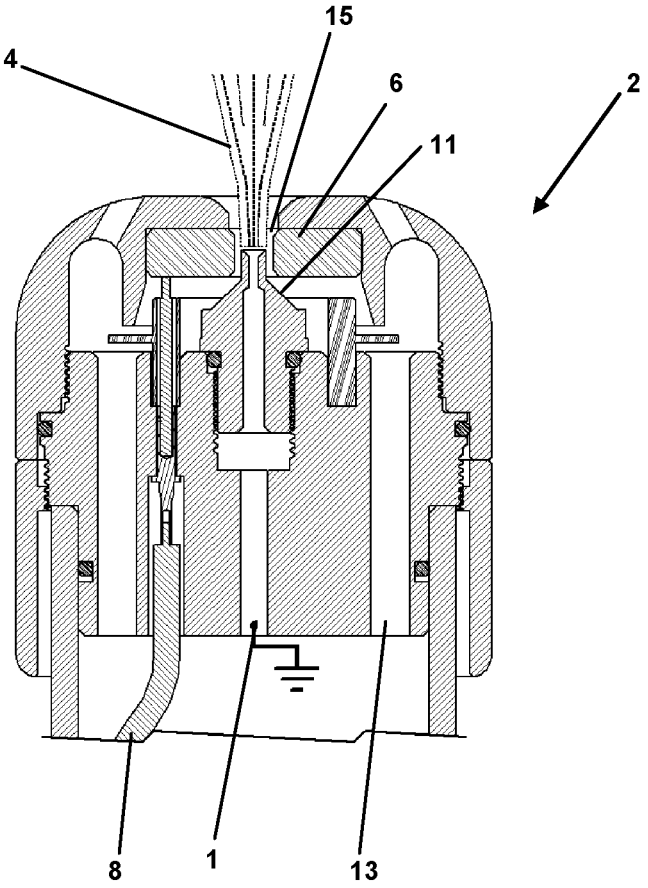
FIG. 2 is a cross-section of an electrostatic spray nozzle assembly that may be used within electrostatic spray head 10 of FIG. 1.

Referring now to FIG. 2, details of a nozzle assembly 2 of sprayer head 10 are shown. The nozzle assembly 2 includes a liquid tip 11 that ejects the liquid and an electrode 6 that charges a spray 4 formed by droplets of the liquid, as described above. Air or other pressurized gas is provided to nozzle assembly 2 and passes though a gas channel 13 to form an air sheath 15 that surrounds the liquid as it is ejected from liquid tip 11. Liquid enters nozzle assembly 2 through a separate liquid channel 1. The liquid may be connected to earth or a reference voltage differing from that of electrode 6 at some location within nozzle assembly 2 or at any point upstream of nozzle assembly 2 including the liquid source, such as a tank within base unit 5 of FIG. 1. Liquid is ejected from liquid tip 11 where the liquid is atomized by the high velocity gas, usually air, flowing around liquid tip 11 and through electrode 6. The collimated spray, which is a stream of atomized liquid droplets exits as a charged spray 4. Further details of an example of a nozzle suitable for use in the system disclosed herein are given in U.S. Pat. No. 9,138,760 entitled "ELECTROSTATIC LIQUID SPRAY NOZZLE HAVING AN INTERNAL DIELECTRIC SHROUD", the disclosure of which is incorporated herein by reference.

Figure 3:
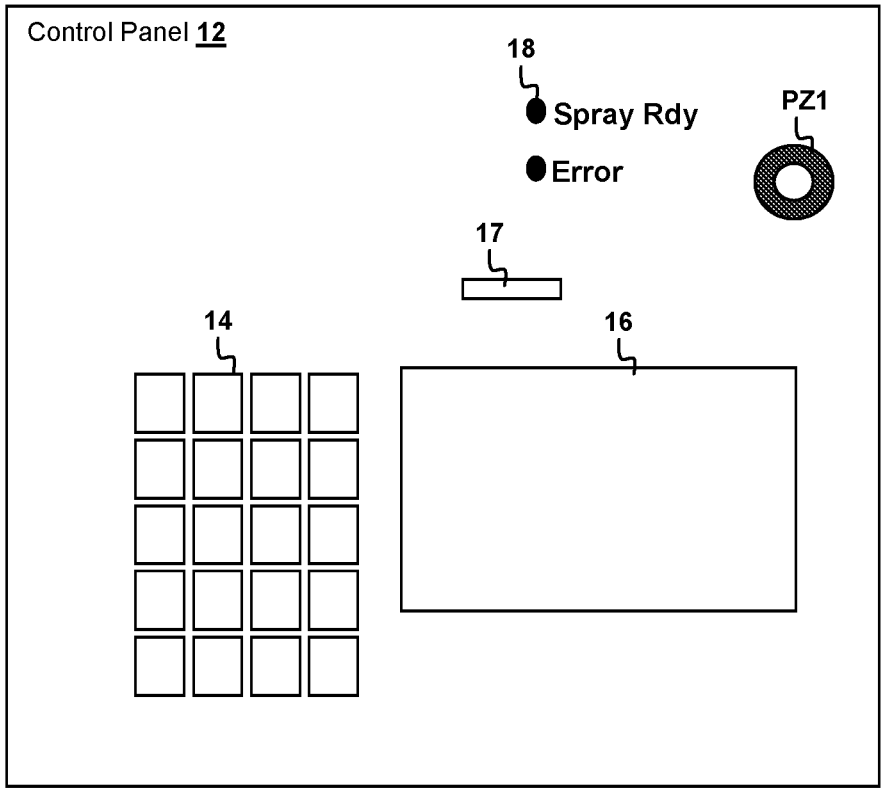
FIG. 3 is a pictorial diagram showing an interface panel of an exemplary electrostatic sprayer system.

Referring now to FIG. 3, an exemplary control panel 12 of an electrostatic sprayer system is shown, as may be located on base unit 5, sprayer head 10 or in some embodiments such as the sprayer system described below with respect to FIG. 5B, a graphical user interface of a mobile device, such as a smart phone, pad or tablet associated with the user. While depicted as discrete controls and indicators, control panel 12 may be implemented with a graphical display with integrated touchscreen, or other suitable user interface integrated on base unit 5 and/or sprayer head 10. Control panel 12 includes a display 16 and input devices such as a keypad 14 or a touchscreen integrated with display 16. Control panel 12 may also include features such as a key or card reader 17, in which the user can insert a physical token for authorization of use of the electrostatic sprayer system, but alternatively, or in combination, a logical token such as a password or PIN code may be entered via keypad 14 or a touchscreen integrated with display 16. Key or card reader 17 may be a Universal Serial Bus (USB) port into which a flash memory stick is inserted, and which may provide not only identification of an operator and an indication of their certified status, but also may be used to transport usage data back to the database. Alternatively, or in combination, a biometric input device such as a fingerprint reader or face recognizer may be used to determine the certification status of the user. A piezoelectric buzzer PZ1 or speaker can be used to provide audible alerts, but also may provide auditory feedback for keypad 14 and/or a touchscreen integrated with display 16, as well as voice direction in some applications. Indicators 18 may be provided to indicate error conditions or sprayer ready conditions, and the like.

Figure 4:
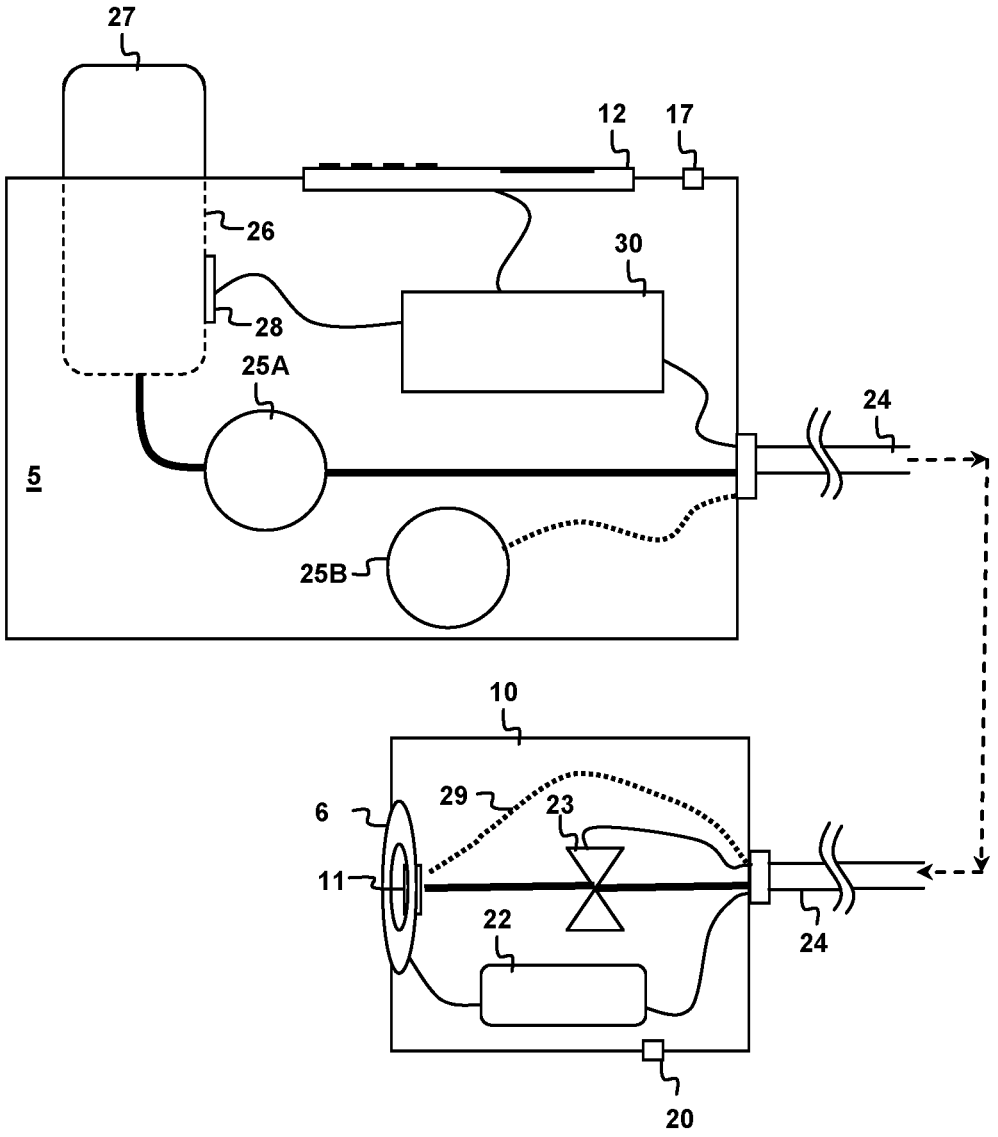
FIG. 4 is a pictorial diagram showing internal details of components within an exemplary electrostatic sprayer system.

Referring now to FIG. 4, exemplary internal features of base unit 5 and sprayer head 10 are shown. The exemplary configuration is intended to show various components that support various features of electrostatic spray systems as disclosed herein and should not be considered limiting as to the location or inclusion of the various components, as some electronic sprayer systems that incorporate the features disclosed herein may not have a separate sprayer head and some sprayer head configurations may not be connected to a separate base unit. Within base unit 5, a removable liquid cartridge 27, which contains a particular type of liquid to be dispensed as an electrostatically charged spray is inserted in a recess 26 of the housing of base unit 5. A reader unit 28 is included adjacent to recess 26 to read information from removable liquid cartridge 27, which may include one or more of: a type of the spray compound contained in removable liquid cartridge 27, a unique identifier associated with the particular removable liquid cartridge 27, a classification of the spray formula, flow characteristics, re-entry intervals, and/or other application information that can be read by base unit 5. The information read by reader 28 can be used to determine the various authorization restrictions disclosed herein for the particular spray compound, the lifetime of the removable liquid cartridge 27, parameters of the electrostatic sprayer system such as electrode voltage, air pressure and liquid flow, and may also be used in conjunction with other data to determine whether the user is certified for the particular spray compound. Reader 28 may be a wired or wireless electronic interface (e.g., RFID tag) to a circuit integrated in or on removable liquid cartridge 27, a magnetic interface that reads a magnetic stripe or other storage on removable liquid cartridge 27, or an optical interface that reads a bar code or other information encoded on or in removable liquid cartridge 27. Alternatively the information may be obtained by scanning a bar code or QR code attached to removable liquid cartridge 27 or a container having the spraying agent that has been used to fill removable liquid cartridge 27. Alternatively, the liquid forming or containing the spray compound may be poured into a fixed tank located on sprayer head 5 or in base unit 10 and the information read, e.g., via bar code reader or QR scan code reader, or user input to control panel 12 or a remote application of a mobile device can identify the spray compound. The embodiment of the sprayer system described below with respect to FIG. 5B includes a mobile device that could be used to scan a bar or QR code and send the information to the sprayer system, or to add such information to the usage reporting sent to the database. The user may enter the information via the mobile device or via an input device on base unit 5 or sprayer head 10. Other information such as expiration date, manufacturing date, spray distance or range, spray volume per unit area, initial volume and remaining volume of liquid can also be read from removable liquid cartridge 27 via reader 28, entered via user input or read from a database in response to a bar code or QR code scan. Other information such as warnings and spray compound specific instructions may also be retrieved and displayed.

Base unit 5 further includes a liquid pump 25A, an air compressor 25B, control panel 12, key or card reader 17 and a control unit 30 that controls operation of the electrostatic sprayer system. A cable 24 that includes a tube conducting the liquid media pumped from removable liquid cartridge 27 by liquid pump 25A, a hose 29 providing compressed air around liquid tip 11, and electronic wiring between control unit and sprayer head 10, such as inputs for a high-voltage electrode power supply 22 that supplies the voltage and current to electrode 6 surrounding liquid tip 11 of sprayer head 10 and optionally control of a valve 23 that controls liquid flow through, as well as control signals from controls of sprayer 10 such as on/off or trigger pressure indications from a trigger switch 20. Wireless connections may alternatively be used for the control signals provided to valve 23 and to base unit 5 from sprayer head 10. Alternatively, liquid pump 25A could be replaced by an air pump that pressurizes the liquid tank to eject the liquid, or the liquid may be drawn from liquid tip 11 of sprayer head 10 by a Venturi effect caused by air flow past liquid tip 11. If liquid pump 25A is not provided, valve 23 may be needed to control the flow of the liquid, or alternatively, the pressure of air provided from air compressor 25B may be used to control the flow of the liquid. Valve 23 also could be manually triggered to turn the liquid supply on or off during spraying, or another valve can be used to turn off air supplied to cartridge 27 during spraying. In general, the flow of liquid to liquid tip 11 is interrupted/prevented if the certification status of the user is not confirmed, and is performed by: de-activating a pump, valve, or supply of pressurized air that moves liquid to liquid tip 11, and by de-activating flow of air from the air compressor when the Venturi effect is used to draw the liquid from liquid tip 11.

Figure 5A:
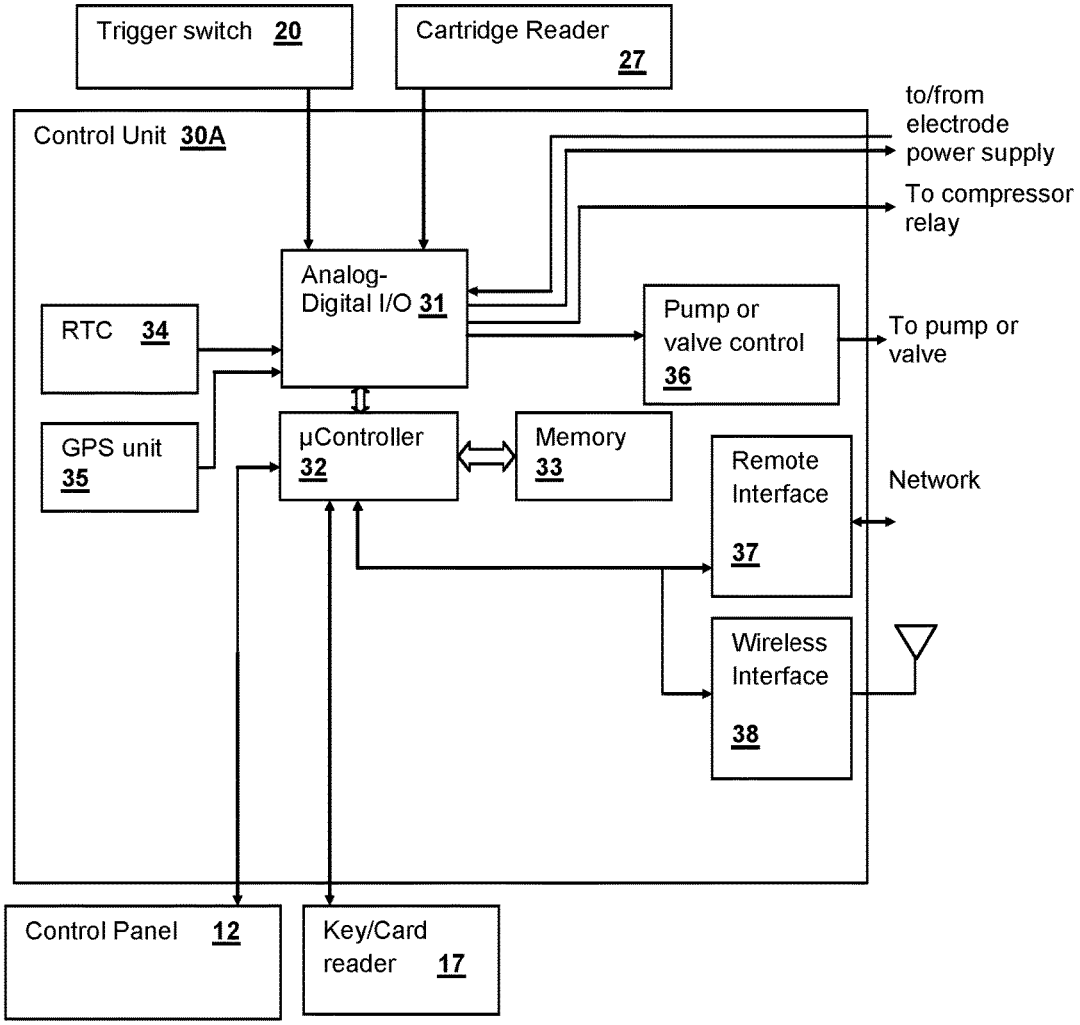
FIG. 5A is a block diagram showing example circuits that may be included in exemplary electrostatic sprayer system of FIG. 4.

Referring now to FIG. 5A, details of control unit 30A for the example electrostatic sprayer are shown. A microcontroller 32 receives inputs and controls operation of the electrostatic sprayer via a program, i.e., a computer program product, stored in a memory 33, which also stores data. An analog/digital I/O unit 31 receives signals from internal circuits of the electrostatic sprayer and generates control output signals according to the program contained in memory 33, which forms a computer program product having unique features as described herein. A real-time clock (RTC) 34 provides control unit 30A with timebase information used for time-stamping usage information that is stored in memory 33 and may be sent to a remote computer system via a wireless interface 38, a wired network interface, or a dedicated remote interface 37 to which a cable is attached between the remote computer system and the electrostatic sprayer periodically to download the usage data. Wireless interface 38 may be a 802.11 "wifi" interface, a Bluetooth Interface, a Near-Field interface, an audio link or an optical link such as an infrared (IR) link. Wireless interface 38 may link directly with the remote computer, or may interact with an application or systems' function on a wireless device, such as a tablet or mobile telephone used by the user in conjunction with the electrostatic sprayer. For example, wireless interface 38 may be a Bluetooth® interface that communicates with an application executing within a mobile telephone of the user, and which communicates via a mobile data network with a remote service via IP (Internet Protocol). Alternatively, wireless interface 38 may be a wi-fi interface capable of connecting directly with any public 802.11 network, and may be supported when no public wi-fi is available by a wireless hotspot application executing on the user's mobile telephone. The above examples are not limiting and it is contemplated that any available network connection, including bridged or routed connections, between control unit 30A and a remote base computer system can be used. Alternatively, control unit 30A may be tethered to another mobile device via remote interface 37, which may be, for example, a universal serial bus (USB) interface that receives a USB flash drive as a token and/or data transfer mechanism for transporting collected per-job usage, liquid type and/or spray protocol and sprayer operational parameter information to a database. As an alternative to the above-described token input, the user's mobile device could be used as an authentication token via wired or wireless connection to wireless interface 38.

Control unit 30 also includes a global positioning system (GPS) receiver 35 for determining a location of the electrostatic sprayer, although alternatively, control unit 30 may obtain location information by polling an application executing on one of the above-mentioned mobile devices and in communication with control unit 30 via wireless interface 38 or via a wired connection to remote interface 37. Microcontroller 32 is also interfaced to control panel 12 and key/card reader 17 to provide functions as described herein. Analog-Digital I/O 31 further provides signals to a pump motor or valve control 36 and/or air compressor relay. In some configurations, the air compressor control forms the entire control mechanism for activating and deactivating the sprayer system, since the liquid being sprayed may be gravity fed or drawn by the compressed air stream via Venturi effect, and while de-activating the electrode power supply is generally desirable, it is not necessary to stop the spray. Analog-Digital I/O 31 also provides input power for electrode power supply 22 which generally will be located close to electrode 21. Analog-Digital I/O 31 includes analog-to-digital converters (ADCs) and digital-to-analog converters (DACs) as required to convert analog signals to digital information and vice-versa. Analog-Digital I/O 31 may be provided by converters integrated within microcontroller 32. Analog-Digital I/O 31 receives a feedback signal from electrode power supply 22 indicating the current drawn by electrode 21, which informs microcontroller 32 of the level of the current. As noted above, the current level and changes in the current provide indications of whether the instant spray protocol is correct as to proper operation of the electrode (non-shorting), the amount of spray flow and the type/concentration of liquid being sprayed, since changing any of the above parameters and conditions will generally change the current signature of the sprayer, i.e., the initial electrode current and/or the electrode current over time as the spray job is being performed. In general, if all of the conditions are met for dispensing the particular spray compound loaded in the electrostatic sprayer as described in the access methods described herein, then pump motor power supply 36 and the input power to electrode power supply are enabled when the user pulls the trigger of sprayer head 10 or otherwise activates an electrostatic sprayer having the features described herein, and information indicative of whether the job has been completed with the proper spray protocol are logged by microcontroller 32 for on-line or off-line upload to the database.

Figure 5B:
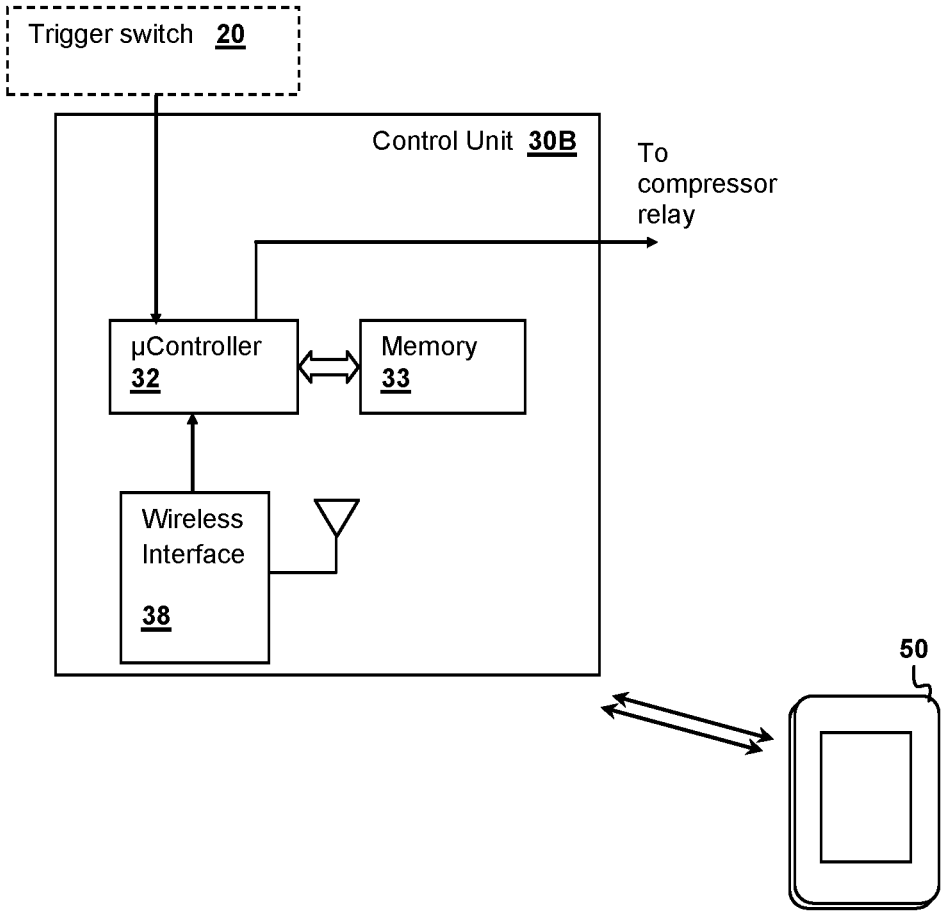
FIG. 5B is a block diagram showing alternative example circuits that may be included in the exemplary electrostatic sprayer system of FIG. 4.

Referring now to FIG. 5B, details of an alternative control unit 30B for the example electrostatic sprayer are shown. Control unit 30B relies upon a connection to an external wireless mobile device 50 via BLUETOOTH, Wi-fi, near-field communication (NFC) or a tethered connection, to obtain information such as geo-location, user identification, biometrics, liquid container information, etc. Communication with a remote database can also be made via the data network available to mobile device 50 in order to obtain the users certification status, and to transmit per-job spray protocol and device information for storage in the database. Mobile device 50 can also retrieve the spray protocol instructions, warnings, liquid information, etc. and display those to the user. Even if a data network is inaccessible by mobile device 50, mobile device 50 can still be used for off-line data storage for later synchronization, as described above with respect to USB flash memory devices or memory cards. All of the above functionality can be provided via an application, i.e., "App" executing within the mobile device 50, which can effectively serve as the user interface control panel for the electrostatic spray system. As such control unit 30B represents a minimal implementation, retaining only some components from the control unit 30A of FIG. 5A: microcontroller 32, memory 33 and wireless interface 38 by which control unit 30B communicates with mobile device 50. Trigger switch 20 may not be required, as the application executing on mobile device 50 could be used to control the air compressor, etc.

Figure 6:
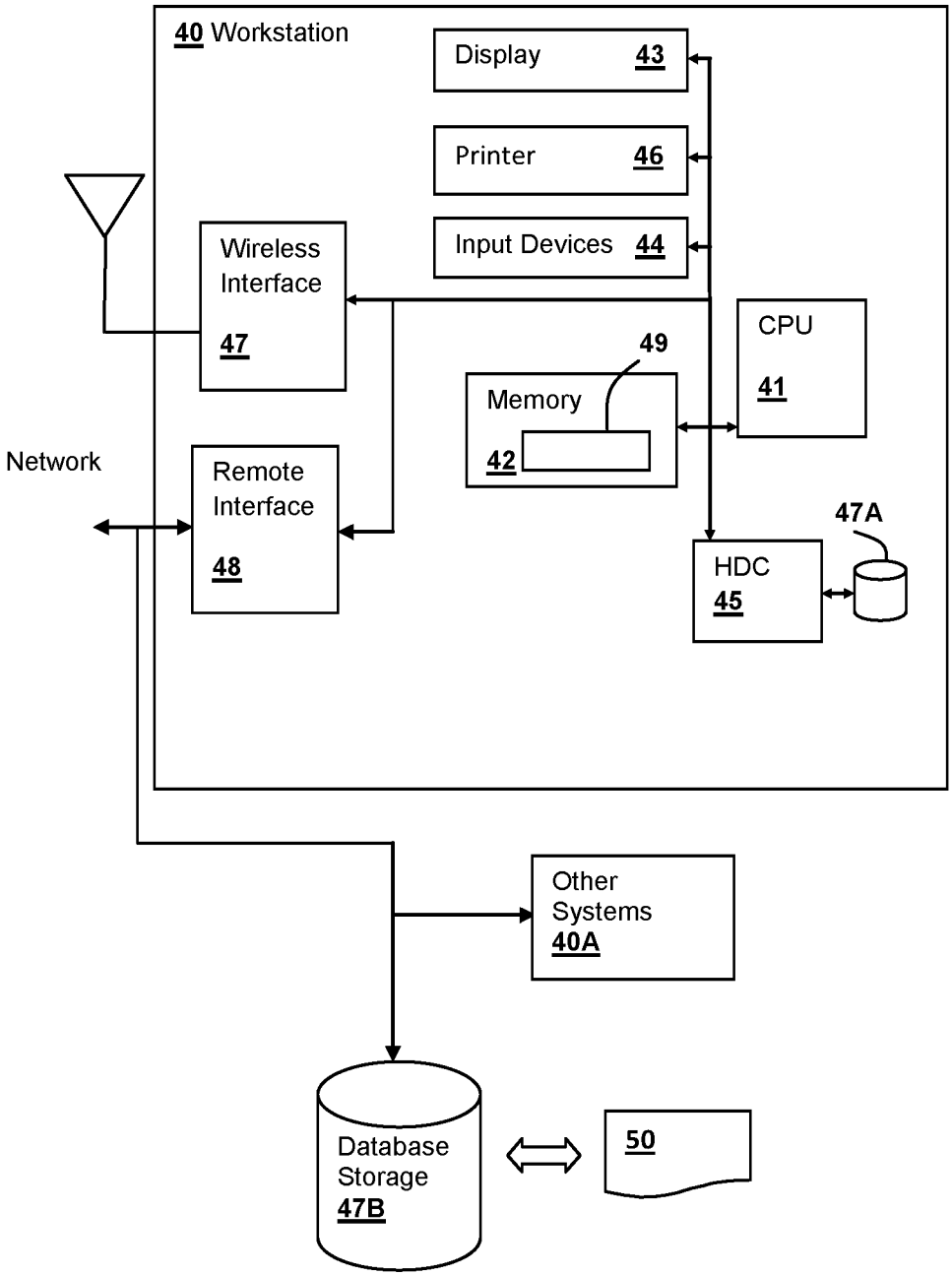
FIG. 6 is an electronic block diagram showing organization of a remote computer system with which the exemplary electrostatic sprayer system of FIG. 4 communicates.

Referring now to FIG. 6, details of a remote computer with which the example electrostatic sprayer communicates are shown. A workstation computer 40, which might alternatively be a racked server or other suitable general-purpose computer system, includes a central processing unit (CPU) 41 and a memory 42 storing program instructions 49 as well as data. The storage for the database(s) disclosed herein may be a private server, or may use available cloud services for storage. Workstation computer 40 may or may not include peripherals such as a display 43, printer 46 and input devices 44, such as mice and keyboards. Workstation computer 40 also includes one or more network interfaces such as a remote interface 48, to which sprayers can be directly connected for download of usage data and other information or indirectly connected via the Internet, and a wireless interface 47 which can connect workstation computer 40 to the Internet via an 802.11 connection. Workstation computer 40 also includes a hard disc controller 45 coupled to one or more internal storage devices 47A, which store the program instructions 49 described herein for loading into memory 42, as well as usage data generated for the electrostatic sprayers. Storage for data generated by electrostatic sprayers will generally also include a centralized or distributed database storage 47B, and database storage 47B and workstation computer 40 will generally be coupled to other computer systems 40A having access to data generated by, and which may also be enabled to control, the electrostatic sprayer systems according to the instant disclosure. In general, the information stored in the database will include one or more of a job identifier, a user identifier, operational settings (and parameters during use) of the sprayer, the type of spray compound, the volume of compound sprayed, the coverage area sprayed (as entered by the user or measured via movement sensing using GPS and/or gyro input from a connected mobile phone or integrated sensors), liquid container information, duration of spraying and other information as disclosed herein. For example, the database may record the electrode current of the sprayer and match the logged electrode current to an expected "signature current" for the liquid type, and if the signature current does not match expected values, the user can be notified during sprayer operation and/or the discrepancy can be noted for later analysis. For example, a first liquid type may cause an electrode current of 100 μA to flow for an air pressure setting of 35 psi, while a second liquid type may cause an electrode current of 400 μA to flow at 20 psi. Logging the electrode current during sprayer operation provides a verification of proper operating conditions that includes the air pressure and proper liquid type including active agent concentration. One or more reports 50 are generated from the information collected in database storage 47B including data for confirming that required spray protocols have been followed and completed in the required locations during a previous reporting interval, which may be daily, weekly, monthly, etc., depending on the criticality and frequency of the application of the particular spray compounds being dispensed by the certified operators managed by a given service organization.

Figure 7:
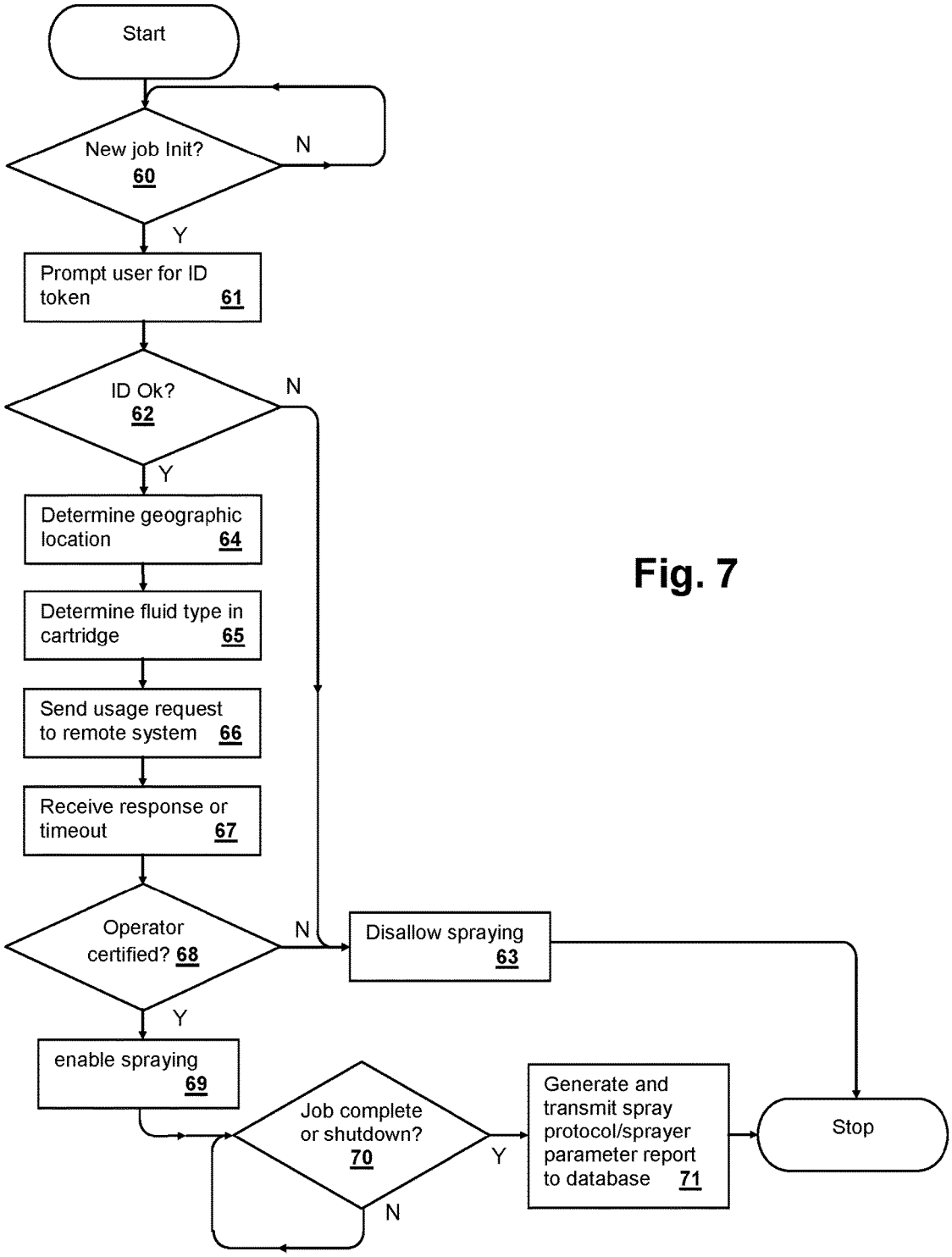
FIG. 7 is a flowchart showing operation of the exemplary electrostatic sprayer system of FIG. 4.

Referring now to FIG. 7, a method according to an example of operation of the electrostatic sprayer system is illustrated in a flowchart. When initiating a new spray job at the sprayer system (decision 60), the user is prompted for their identifying token (step 61), which may be physical (e.g., USB stick) and/or logical (e.g., password or biometric entry on control unit or mobile device) as described above. If the provided token is improper (decision 62), then operation of the sprayer is denied (step 63) until the proper conditions are met. Next, the electrostatic spray system determines the current geographic location (step 64) and a type of spray compound contained in removable cartridge 27 or fixed reservoir (step 65), and transmits usage request information including the user identity, the geographic location and the spray compound type to remote workstation computer system 40 (step 66). The electrostatic sprayer system receives a response indicating whether or not spraying is allowed in the geographic area by the particular user, i.e., whether the user is certified for the particular spray compound and whether the geographic location is appropriate at this time for the spray compound (step 67) and if spraying is allowed (decision 68), the air compressor (and optionally liquid valve 23, liquid pump 25A and electrode power supply 22) are activated immediately or when the user activates trigger 20 or activates the system via mobile device 50 (step 69). Otherwise, if spraying is not allowed, operation of the sprayer is denied (step 63). When the job is complete or the electrostatic spray system is shut down (decision 70) a report is generated with spray protocol and sprayer parameter information and transmitted to the database (or stored locally for later synchronization) (step 71).

Figure 8:
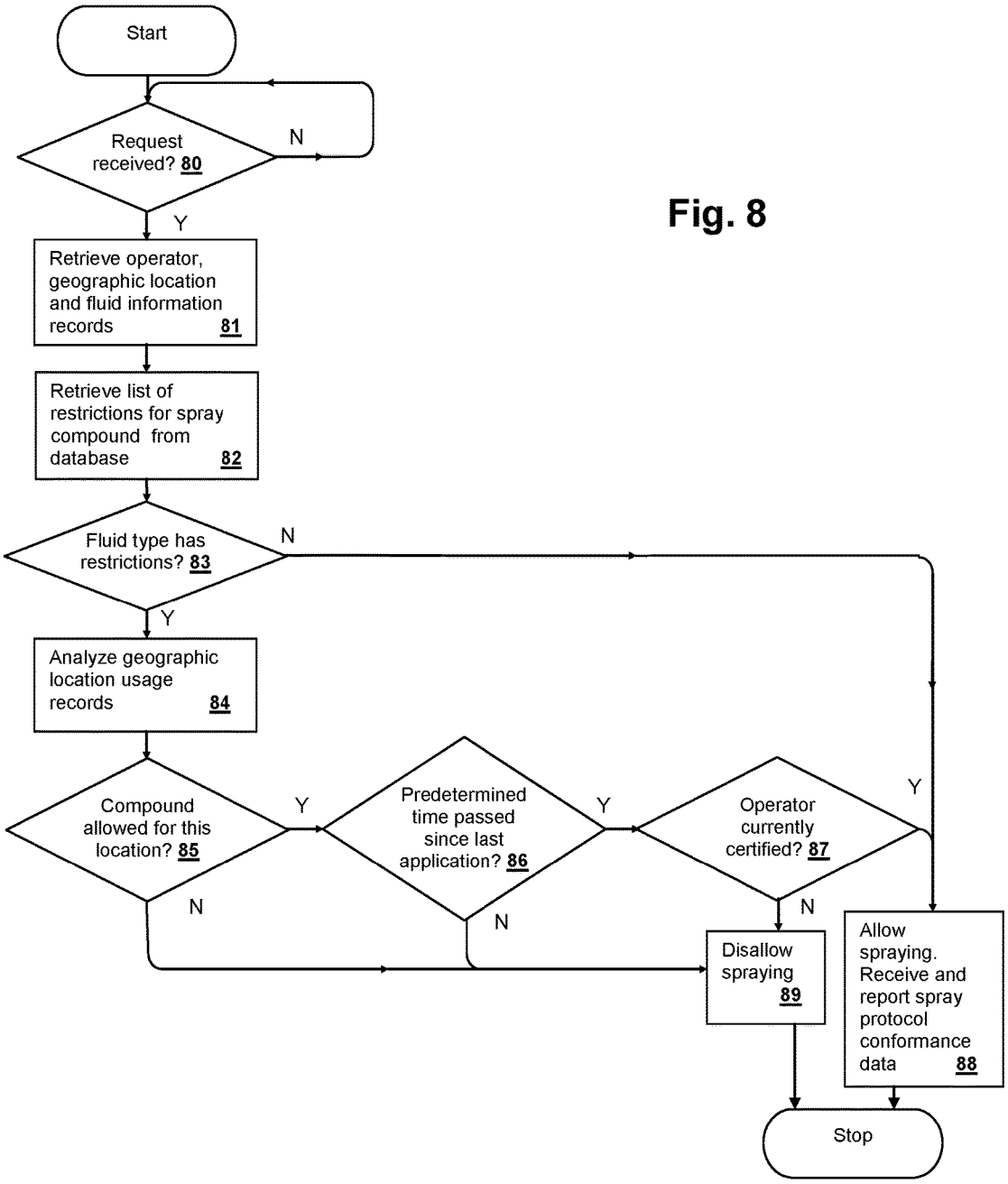
FIG. 8 is a flowchart showing operation of the remote computer system of FIG. 6 interacting with the exemplary electrostatic sprayer system of FIG. 4.

Referring now to FIG. 8, a method according to an example of operation of the remote workstation computer system 40 is illustrated in a flowchart. While the illustrated method presumes real-time connection to a remote database, the decisions shown can be based on local storage that has been populated from the remote database, e.g., the last known certification status of one or more possible users, information regarding spray compound types, etc. When a job initialization request is received by remote workstation computer system 40 (decision 80), user records are retrieved from database storage 47B, as well as previous usage records and descriptors for the geographic location (step 81). The particular spray compound type and user identification received with the usage request is compared with a list of restrictions also retrieved from database storage 47B (step 82) and if the spray compound has usage restrictions (decision 83), the description of the geographic location is retrieved along with previous usage records for the geographic location (step 84). Otherwise, a message is sent to the electrostatic spray system that operation is permitted and spray protocol conformance data is collected from the sprayer system (step 88). If the spray compound type is allowed for the geographic location (decision 85), the particular spray compound has not been previously applied within a predetermined time interval (decision 86) and the user is currently certified to apply the spray compound (decision 87), then a message is communicated to the electrostatic spray system that operation is permitted under the current conditions and spray protocol conformance data is collected during spraying (step 88), otherwise a message is sent that spraying is not permitted (step 89), optionally including information permitting the user to determine the cause. The predetermined time interval used to determine whether to enable spraying in a geographic location for a particular spray compound may be a minimum time interval to reduce waste or a minimum time interval for safety for the particular spray compound. Workstation computer system 40 may also communicate a message to the user of the sprayer informing the user to post a notice that one or more rooms corresponding to the geographic location are not to be occupied for a predetermined time after spraying has been completed. Alternatively workstation computer system 40 may send such a message to another party.

In addition to the above-described methods, workstation computer system 40 provides logs and notifications that demonstrate that spray compounds were properly applied at particular times in particular locations. Maintenance logs for sprayers and materials ordering can be generated from the usage information, i.e., application duration x flow rate x concentration=spray compound used. Material disposal can also be managed, e.g., by instructing the user to return an expired cartridge to a predetermined location.

While the invention has been particularly shown and described with reference to the preferred embodiments thereof, it will be understood by those skilled in the art that the foregoing and other changes in form, and details may be made therein without departing from the spirit and scope of the invention.

What is claimed is:

1. An electrostatic sprayer system comprising:

a sprayer head having a sprayer outlet for dispensing an electrically charged liquid, wherein the sprayer head includes a liquid outlet for emitting the liquid and an electrode proximate the liquid outlet for charging the liquid;

an air compressor for supplying pressurized air to the sprayer head to form an air sheath between the liquid outlet and the electrode to eject the charged liquid from the sprayer outlet;

a vessel containing the liquid prior to dispensing;

a power supply for providing a voltage and a current to the electrode;

a flow controller for controlling a flow of the liquid emitted from the liquid outlet;

a control system for controlling the flow controller in conformity with a certification status of a user of the sprayer system on a per-job basis and reporting usage of the sprayer system by the user for a current job to a database; and a wireless interface for wirelessly coupling to a mobile device of the user, wherein the control system receives an identity of the user of the sprayer system from an application executing within the mobile device, and wherein the electrostatic sprayer system retrieves the certification status of the user from the database using the identity of the user received from the application.

2. The electrostatic sprayer system of claim 1, wherein the control system further reports information indicative of whether a spray protocol for the liquid has been followed.

3. The electrostatic sprayer system of claim 2, wherein the information indicative of whether a spray protocol for the liquid has been followed includes a type of spraying agent contained in or formed by the liquid.

4. The electrostatic sprayer system of claim 2, wherein the information indicative of whether a spray protocol for the liquid has been followed includes an identity of the user.

5. The electrostatic sprayer system of claim 2, wherein the information indicative of whether a spray protocol for the liquid has been followed includes an operating parameter of the sprayer head.

6. The electrostatic sprayer system of claim 2, wherein the information indicative of whether a spray protocol for the liquid has been followed includes a geographic location of the sprayer head.

7. The electrostatic sprayer system of claim 2, wherein the information indicative of whether a spray protocol for the liquid has been followed includes a duration of the usage of the sprayer system.

8. The electrostatic sprayer system of claim 1, wherein the control system receives the certification status of the user of the sprayer system from an application executing within the mobile device.

9. The electrostatic sprayer system of claim 7, wherein the control system reports usage of the sprayer system to the database using the wireless interface, whereby the usage is transmitted from the mobile device to the database.

10. A method of spraying a liquid using a sprayer system, comprising:

directing electrically charged liquid from a sprayer head of the sprayer system, the sprayer head having a sprayer outlet for dispensing the electrically charged liquid, wherein the sprayer head includes a liquid outlet for emitting the liquid and an electrode proximate the liquid outlet for charging the liquid;

supplying pressurized air from an air compressor of the sprayer system to the sprayer head to form an air sheath between the liquid outlet and the electrode to eject the charged liquid from the sprayer outlet;

storing the liquid in a vessel of the sprayer system prior to dispensing;

providing a voltage and a current to the electrode from a power supply of the sprayer system;

controlling flow of the liquid emitted from the liquid outlet with a flow controller of the sprayer system in conformity with a certification status of a user of the sprayer system on a per-job basis and reporting usage of the sprayer system by the user for a current job to a database;

receiving an identity of the user of the sprayer system from an application executing within a mobile device of the user that communicates wirelessly with the sprayer system via a wireless interface of the sprayer system that is wirelessly coupled to the mobile device of the user; and the sprayer system retrieving the certification status of the user from the database using the identity of the user received from the application.

11. The method of claim 10, further comprising reporting information indicative of whether a spray protocol for the liquid has been followed to the database.

12. The method of claim 11, wherein the information indicative of whether a spray protocol for the liquid has been followed includes a type of spraying agent contained in or formed by the liquid.

13. The method of claim 11, wherein the information indicative of whether a spray protocol for the liquid has been followed includes an identity of the user.

14. The method of claim 11, wherein the information indicative of whether a spray protocol for the liquid has been followed includes an operating parameter of the sprayer head.

15. The method of claim 11, wherein the information indicative of whether a spray protocol for the liquid has been followed includes a geographic location of the sprayer head.

16. The method of claim 11, wherein the information indicative of whether a spray protocol for the liquid has been followed includes a duration of the spraying.

17. The method of claim 10, further comprising receiving the certification status of the user of the sprayer system from the aft application executing within the mobile device of the user.

18. The method of claim 17, further comprising reporting usage of the sprayer system to the database by transmitting usage information from the mobile device to the database.

19. An electrostatic sprayer system comprising:

a sprayer head having a sprayer outlet for dispensing an electrically charged liquid, wherein the sprayer head includes a liquid outlet for emitting the liquid and an electrode proximate the liquid outlet for charging the liquid;

an air compressor for supplying pressurized air to the sprayer head to form an air sheath between the liquid outlet and the electrode to eject the charged liquid from the sprayer outlet;

a vessel containing the liquid prior to dispensing;

a power supply for providing a voltage and a current to the electrode;

a flow controller for controlling a flow of the liquid emitted from the liquid outlet; and a control system for controlling the flow controller in conformity with a certification status of a user of the sprayer system on a per-job basis and reporting usage of the sprayer system by the user for a current job to a database, wherein an identity of the user is associated with the electrostatic sprayer system via information stored in a removable or non-removable memory coupled to the control system, and wherein the electrostatic sprayer system retrieves the certification status of the user from the database using the identity of the user retrieved from the removable or non-removable memory.

20. A method of spraying a liquid using a sprayer system, comprising:

directing electrically charged liquid from a sprayer head of the sprayer system, the sprayer head having a sprayer outlet for dispensing the electrically charged liquid, wherein the sprayer head includes a liquid outlet for emitting the liquid and an electrode proximate the liquid outlet for charging the liquid;

supplying pressurized air from an air compressor of the sprayer system to the sprayer head to form an air sheath between the liquid outlet and the electrode to eject the charged liquid from the sprayer outlet;

storing the liquid in a vessel of the sprayer system prior to dispensing;

providing a voltage and a current to the electrode from a power supply of the sprayer system;

controlling flow of the liquid emitted from the liquid outlet with a flow controller of the sprayer system in conformity with a certification status of a user of the sprayer system on a per-job basis and reporting usage of the sprayer system by the user for a current job to a database;

associating an identity of the user with the electrostatic sprayer system by storing information in a removable or non-removable memory coupled to the sprayer system;

retrieving the identity of the user from the stored information in the removable or non-removable memory coupled to the sprayer system; and retrieving the certification status of the user from the database using the identity retrieved from the removable or non-removable memory coupled to the sprayer system.

21. An electrostatic sprayer system comprising:

a sprayer head having a sprayer outlet for dispensing an electrically charged liquid, wherein the sprayer head includes a liquid outlet for emitting the liquid and an electrode proximate the liquid outlet for charging the liquid;

a vessel containing the liquid prior to dispensing;

a power supply for providing a voltage and a current to the electrode;

a flow controller for controlling a flow of the liquid emitted from the liquid outlet;

a control system for controlling the flow controller in conformity with a certification status of a user of the sprayer system on a per-job basis and reporting usage of the sprayer system by the user for a current job to a database; and a wireless interface for wirelessly coupling to a mobile device of the user, wherein the control system receives an identity of the user of the sprayer system from an application executing within the mobile device, and wherein the electrostatic sprayer system retrieves the certification status of the user from the database using the identity of the user received from the application.

22. An electrostatic sprayer system comprising:

a sprayer head having a sprayer outlet for dispensing an electrically charged liquid, wherein the sprayer head includes a liquid outlet for emitting the liquid and an electrode proximate the liquid outlet for charging the liquid;

a vessel containing the liquid prior to dispensing;

a power supply for providing a voltage and a current to the electrode;

a flow controller for controlling a flow of the liquid emitted from the liquid outlet; and a control system for controlling the flow controller in conformity with a certification status of a user of the sprayer system on a per-job basis and reporting usage of the sprayer system by the user for a current job to a database, wherein an identity of the user is associated with the electrostatic sprayer system via information stored in a removable or non-removable memory coupled to the control system, and wherein the electrostatic sprayer system retrieves the certification status of the user from the database using the identity of the user retrieved from the removable or non-removable memory.

23. A method of spraying a liquid using a sprayer system, comprising:

directing electrically charged liquid from a sprayer head of the sprayer system, the sprayer head having a sprayer outlet for dispensing the electrically charged liquid, wherein the sprayer head includes a liquid outlet for emitting the liquid and an electrode proximate the liquid outlet for charging the liquid;

storing the liquid in a vessel of the sprayer system prior to dispensing;

providing a voltage and a current to the electrode from a power supply of the sprayer system;

controlling flow of the liquid emitted from the liquid outlet with a flow controller of the sprayer system in conformity with a certification status of a user of the sprayer system on a per-job basis and reporting usage of the sprayer system by the user for a current job to a database;

receiving an identity of the user of the sprayer system from an application executing within a mobile device that communicates wirelessly with the sprayer system; and retrieving the certification status of the user from the database using the identity of the user received from the application.

24. A method of spraying a liquid using a sprayer system, comprising:

directing electrically charged liquid from a sprayer head of the sprayer system, the sprayer head having a sprayer outlet for dispensing the electrically charged liquid, wherein the sprayer head includes a liquid outlet for emitting the liquid and an electrode proximate the liquid outlet for charging the liquid;

storing the liquid in a vessel of the sprayer system prior to dispensing;

providing a voltage and a current to the electrode from a power supply of the sprayer system;

controlling flow of the liquid emitted from the liquid outlet with a flow controller of the sprayer system in conformity with a certification status of a user of the sprayer system on a per-job basis and reporting usage of the sprayer system by the user for a current job to a database;

associating an identity of the user with the electrostatic sprayer system by storing information in a removable or non-removable memory coupled to the sprayer system;

retrieving the identity of the user from the stored information in the removable or non-removable memory; and retrieving the certification status of the user from the database using the identity retrieved from the removable or non-removable memory.

* * * * *